US010229783B2

(12) United States Patent
Kang

(10) Patent No.: US 10,229,783 B2
(45) Date of Patent: Mar. 12, 2019

(54) INDUCTOR AND ELECTRONIC DEVICE INCLUDING THE SAME

(71) Applicant: SAMSUNG ELECTRONICS CO., LTD., Suwon-si (KR)

(72) Inventor: Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 8 days.

(21) Appl. No.: 14/245,258

(22) Filed: Apr. 4, 2014

(65) Prior Publication Data

US 2014/0368306 A1 Dec. 18, 2014

(30) Foreign Application Priority Data

Jun. 17, 2013 (KR) ..... 10-2013-0069060

(51) Int. Cl.
*H01F 27/29* (2006.01)
*H01F 27/24* (2006.01)
(Continued)

(52) U.S. Cl.
CPC ..... *H01F 38/08* (2013.01); *H01F 3/12* (2013.01); *H01F 27/06* (2013.01); *H01F 2027/065* (2013.01)

(58) Field of Classification Search
CPC ..... H01F 22/027; H01F 27/292; H01F 2027/065; H05K 2201/1003; H05K 3/306; H05K 1/182; H05K 1/18; H05K 1/186
(Continued)

(56) References Cited

U.S. PATENT DOCUMENTS 2,030,648 A * 2/1936 Meissner ..... H04R 9/022 165/183
2,513,160 A * 6/1950 Friend ..... H01F 21/06 315/405
(Continued)

FOREIGN PATENT DOCUMENTS

CA 553564 A 2/1958
CN 102592803 A 7/2012
(Continued)

OTHER PUBLICATIONS

Extended European Search Report dated Apr. 6, 2017 issued by European Patent Office in counterpart European Application No. 13197132.7.
(Continued)

*Primary Examiner* — Alexander Talpalatski
*Assistant Examiner* — Joselito Baisa
(74) *Attorney, Agent, or Firm* — Sughrue Mion, PLLC

(57) ABSTRACT

An inductor and an electronic device including the same are provided. The inductor includes: a coil in which an electric current flows; and a core that the coil is wound around, wherein the core includes a central portion that the coil is wound around; extensions extending from opposite edges of the central portions; and lateral portions extending from the extensions along the circulation path of the magnetic flux and facing the central portion with the coil disposed there between, and a first height at a first position of the extension portions on the circulation path of the magnetic flux spaced away from the edges of the central portion by a first distance which is larger than a second height at a second position on the circulation path of the magnetic spaced away from the edges of the central portion by a second distance which is longer than the first distance.

10 Claims, 10 Drawing Sheets

(51) Int. Cl.
*H01F 38/08* (2006.01)
*H01F 3/12* (2006.01)
*H01F 27/06* (2006.01)

(58) Field of Classification Search
USPC ..... 336/65, 192, 208, 214, 215
See application file for complete search history.

(56) References Cited

U.S. PATENT DOCUMENTS 2,779,926 A * 1/1957 Johnson ..... H01F 27/245 336/170
3,196,373 A * 7/1965 Jones ..... H01F 29/146 336/155
3,755,767 A * 8/1973 Hendrickson ..... F02D 41/30 336/134
4,047,138 A * 9/1977 Steigerwald ..... 336/100
4,675,638 A * 6/1987 Szabo ..... H01F 17/043 336/120
5,168,440 A * 12/1992 Spreen ..... H01F 27/2847 336/226
5,382,937 A * 1/1995 Saitoh ..... H01F 21/06 336/134
5,684,446 A * 11/1997 Adkins ..... H01F 27/02 336/196
5,760,669 A * 6/1998 Dangler ..... H01F 17/043 336/192
6,014,071 A 1/2000 Onishi et al.
6,115,236 A * 9/2000 Jedlitschka ..... H02M 7/106 174/50
6,380,834 B1 * 4/2002 Canzano ..... H01F 27/2804 336/200
6,587,026 B2 * 7/2003 Yeh ..... H01F 27/2804 336/200
6,727,793 B2 * 4/2004 Piechnick ..... H01F 5/02 336/198
6,844,802 B2 * 1/2005 Drummond ..... H01F 27/22 336/5
7,046,111 B2 5/2006 Sigl
7,154,365 B2 * 12/2006 Park ..... H01F 27/06 336/192
7,429,907 B2 9/2008 Tung et al.
7,564,335 B1 * 7/2009 Yang ..... H01F 27/06 336/192
7,598,837 B2 * 10/2009 Gilmartin ..... H01F 17/043 336/192
8,142,870 B2 * 3/2012 Keady ..... A61F 11/10 128/864
8,203,407 B2 * 6/2012 Lin et al. ..... 336/83
8,242,870 B1 * 8/2012 Folker ..... H01F 3/10 336/192
8,514,048 B2 * 8/2013 Tseng ..... H05K 1/182 336/192
8,648,687 B2 * 2/2014 Li ..... H01F 27/06 336/198
9,251,945 B2 * 2/2016 Barthold ..... H01F 27/2804
9,622,297 B2 * 4/2017 Tonomura ..... H05B 6/36
2002/0030574 A1 * 3/2002 Sato ..... H01F 29/146 336/110
2006/0097837 A1 * 5/2006 Yamasaki ..... H01F 30/06 336/208
2008/0231406 A1 9/2008 Lin et al.
2010/0039207 A1 * 2/2010 Kaneko ..... H01F 27/306 336/221
2010/0156584 A1 6/2010 Yamaguchi et al.
2010/0219926 A1 * 9/2010 Willers ..... H01F 27/06 336/200
2012/0169448 A1 * 7/2012 Tseng et al. ..... 336/208

FOREIGN PATENT DOCUMENTS

JP S54-43533 A 4/1979
TW 200839802 A 10/2008

OTHER PUBLICATIONS

Office Action dated Mar. 2, 2017 issued by The State Intellectual Property Office of P.R. China in counterpart Chinese Application No. 201410250661.X.
Communication dated Jun. 28, 2018, issued by the State Intellectual Property Office of P.R. China in counterpart Chinese Application No. 201410250661.X.

* cited by examiner

INDUCTOR AND ELECTRONIC DEVICE INCLUDING THE SAME

CROSS-REFERENCE TO RELATED APPLICATION

This application claims priority from Korean Patent Application No. 10-2013-0069060, filed on Jun. 17, 2013 in the Korean Intellectual Property Office, the disclosure of which is incorporated herein by reference, in its entirety.

BACKGROUND

Field

Apparatuses consistent with the exemplary embodiments relate to an inductor and an electronic device including the same. More particularly, the exemplary embodiments relate to an improved inductor which reduces a height of an inductor core and secures current capacity, and an electronic device including the same.

Description of the Related Art

Recently, rapid development in semiconductor technology enables high density integration and high performance of semiconductors, and accordingly electronic products, such as mobile phones, notebooks and TVs, have largely become slim and light weight.

A display apparatus includes an image display using a liquid crystal display (LCD), a light emitting diode (LED) and an organic light emitting diode (OLED). As the display apparatus relatively becomes slim with an increasing area of the image display, an installation space for the display apparatus may be minimized, for example, by installing the display apparatus on a wall.

To manufacture a slim electronic device, electronic components mounted on a printed circuit board (PCB) to drive the electronic device may need to have a minimized height.

FIGS. 1 to 3 illustrate a core of an inductor mounted on a PCB of an electronic device in the related art.

As shown in FIG. 1, the core 1 of the inductor is a hollow rectangular body including an upper portion 3, a lateral portion 4, a lower portion 5, and a cylindrical central portion 2, in which a coil is wounded around the central portion 2 to generate magnetic flux.

As shown in FIG. 2, in the inductor, the coil 6 is wound around the central portion 2 of the core 1. When an electric current flows into a right side of a coil and out of a left side of the coil, that is, when an electric current flows counterclockwise, as viewed from a top of the core 1, magnetic flux m is formed in the central portion 2 and passes through the central portion 2, the upper portion 3, the lateral portion 4, the lower portion 5 and then back to the central portion 2 as indicated by arrows. A bottleneck phenomenon occurs in an area f where magnetic flux vertically flowing in the central portion 2 curves to the upper portion 3.

The bottleneck phenomenon of the magnetic flux is determined on a cross-sectional area of the core in which the magnetic flux flows. FIG. 3 is a cross-sectional view, taken along a center of the core 1, in which a cross section a of the central portion 2 and a cross section b of the upper portion 3 are shown as half of their actual sizes.

As shown in FIG. 3, the magnetic flux generated in the central portion 2 passes through the cross section a and then the cross section b of the upper portion 3. Here, the cross section b has an area at least equivalent to or larger than the cross section a so that the bottleneck phenomenon of magnetic flux does not occur in the core 1. Thus, in the core of the related art, the upper portion 3 is formed thick so as to increase the area of the cross section b.

In the thick inductor core, even a portion of the core where the bottleneck phenomenon does not occur is formed thick which causes an unnecessary waste of materials, raising production costs. Also, the inductor has a greater height, making it difficult to apply the inductor to an electronic device that is slim.

SUMMARY

An aspect of one or more exemplary embodiments is to reduce a height of an inductor core and to minimize a bottleneck phenomenon of magnetic flux which may occur in the inductor core.

Another aspect of one or more exemplary embodiments is to provide an inductor which is installed in a slim electronic device, while securing current capacity.

The foregoing and/or other aspects may be achieved by providing an inductor including: a coil in which an electric current flows; and a core that the coil is wound around, wherein the core includes a central portion that the coil is wound around; an extension which extends from opposite edges of the central portion according to a circulation path of magnetic flux generated by the electric current of the coil; and, lateral portions extending from the extension portions along the circulation path of the magnetic flux and facing the central portion with the coil disposed there between, and a first height at a first position of the extension portion on the circulation path of the magnetic flux which is spaced away from the edges of the central portion by a first distance which is larger than a second height at a second position on the circulation path of the magnetic spaced away from the edges of the central portion by a second distance which is longer than the first distance.

A first cross section at the first position may have a predetermined area so that a bottleneck phenomenon of the magnetic flux is not generated at the first position.

The area of the first cross section may be at least equivalent to or larger than a cross-sectional area of the central portion.

A thickness of the extension portions at the first position may be larger than a thickness of the extension portions at the second position.

The core may be provided such that a vertical side which the magnetic flux passes through along the circulation path of the magnetic flux has a uniform area.

The extension portions may include a first extension portion formed above the central portion and a second extension portion formed under the central portion, where the second extension portion includes a connection terminal mounted on a printed circuit board and electrically connected thereto.

At least one of the first extension portion and the second extension portion may include a protrusion which extends from one side thereof such that a thickness at the first position is larger than a thickness at the second position.

According to an aspect of another exemplary embodiment, an inductor is provided including: a coil in which an electric current is configured to flow; and a core that the coil is wound around, wherein the core includes a central portion that the coil is wound around; an extension portion extending from opposite edges of the central according to a circulation path of magnetic flux generated by the electric current of the coil; and lateral portions extending from the extension portions along the circulation path of the magnetic flux and facing the central portion with the coil disposed there between, and the core is provided such that a vertical side which the magnetic flux passes through along the circulation path of the magnetic flux has a uniform area.

The extension portions may include a first extension portion formed above the central portion and a second extension portion formed under the central portion, and the second extension portion includes a connection terminal mounted on a printed circuit board and electrically connected thereto.

The foregoing and/or other aspects may be achieved by providing an electronic device including: a printed circuit board on which an electronic component to drive the electronic device is mounted; and an inductor mounted on the printed circuit board, wherein the inductor includes a coil in which an electric current is configured to flow and a core that the coil is wound around, the core includes a central portion that the coil is wound around, extension portions extending from opposite edges of the central portion according to a circulation path of magnetic flux generated by the electric current of the coil; and lateral portions extending from the extension along the circulation path of the magnetic flux and facing the central portion with the coil disposed there between, and a first height at a first position of the extension portions on the circulation path of the magnetic flux spaced away from the edges of the central portion by a first distance may be larger than a second height at a second position on the circulation path of the magnetic spaced away from the edges of the central portion by a second distance longer than the first distance.

A first cross section at the first position may have a predetermined area so that a bottleneck phenomenon of the magnetic flux is not generated at the first position.

The area of the first cross section is at least equivalent to or larger than a cross-sectional area of the central portion.

A thickness of the extension portions at the first position may be larger than a thickness of the extension portions at the second position.

The core may be provided such that a vertical side which the magnetic flux passes through along the circulation path of the magnetic flux has a uniform area.

The extension portions may include a first extension portion formed above the central portion and a second extension portion formed under the central portion, and the second extension portion may include a connection terminal mounted on the printed circuit board and electrically connected thereto.

At least one of the first extension portion and the second extension portion may include a protrusion extending from one side thereof such that a thickness at the first position is larger than a thickness at the second position.

The printed circuit board may include a hole into which the protrusion is inserted.

According to an aspect of another exemplary embodiment, an electronic device is provided including: a printed circuit board on which an electronic component to drive the electronic device is mounted; and an inductor mounted on the printed circuit board, wherein the inductor includes a coil in which an electric current is configured to flow and a core that the coil is wound around, the core includes a central portion that the coil is wound around, extension portions which extend from opposite edges of the central portion according to a circulation path of magnetic flux generated by the electric current of the coil; and lateral portions which extend from the extension portions along the circulation path of the magnetic flux and facing the central with the coil disposed there between, and the core is provided such that a vertical side which the magnetic flux passes through along the circulation path of the magnetic flux has a uniform area.

The extension portions may include a first extension portion formed above the central portion and a second extension portion formed under the central portion, and the second extension portion includes a connection terminal mounted on the printed circuit board and electrically connected thereto.

The first extension portion and the second extension portion may include a protrusion which extends from one side thereof.

The printed circuit board may include a hole into which the protrusion is inserted.

As described above, an inductor and an electronic device including the same according to exemplary embodiments may minimize a bottleneck phenomenon of magnetic flux which may occur in the inductor core, thereby securing the current capacity of the inductor.

An aspect of an exemplary embodiment may provide an inductor including: a core including a central portion that a coil is configured to be wound around; extension portions which extend from opposite edges of the central portion; and lateral portions which extend from the extension portions along a circulation path of magnetic flux and facing the central portion, and a first height at a first position of the extension portions being spaced away from the edges of the central portion by a first distance which is larger than a second height at a second position which is spaced away from the edges of the central portion by a second distance which is longer than the first distance.

The first height may be on a circulation path of the magnetic flux. The second height may further be on a circulation path of the magnetic flux.

A first cross section at the first position has a predetermined area so that a bottleneck phenomenon of the magnetic flux is not generated at the first position.

The area of the first cross section may be at least equivalent to or larger than a cross-sectional area of the central portion.

A thickness of the extension portions at the first position may be larger than a thickness of the extension portions at the second position.

In addition, the area of the first cross section may be at least equivalent to or larger than a cross-sectional area of the central portion.

Further, in an inductor and an electronic device including the same according to exemplary embodiments, an inductor core includes an improved structure to resolve a bottleneck phenomenon of magnetic flux, with minimum use of core materials and to reduce a height of the inductor core, so that the inductor may be applied to various electronic devices.

In addition, in an inductor and an electronic device including the same, according to exemplary embodiments, an inductor core has a minimized size while maintaining the current capacity of the inductor, thereby reducing production costs.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION OF EXEMPLARY EMBODIMENTS

Hereinafter, an inductor according to exemplary embodiments will be described in detail with reference to the accompanying drawings.

Figure 1:
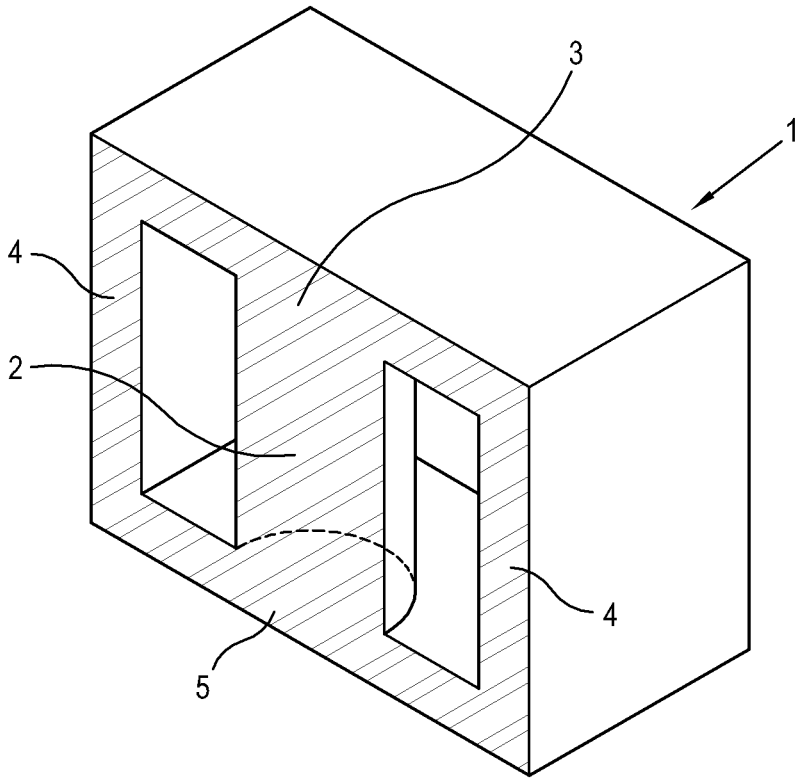
RELATED ART FIG. 1
FIG. 1 is a cross-sectional view schematically illustrating a core of an inductor of the related art.
Figure 2:
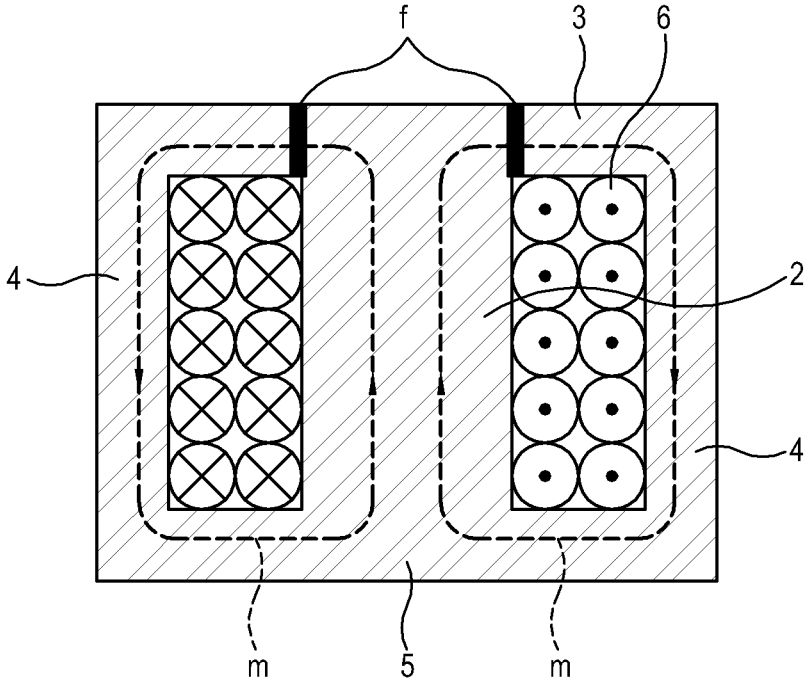
RELATED ART FIG. 2
FIGS. 2 and 3 are cross-sectional views of the core which schematically illustrate a path of magnetic flux circulated in the inductor of the related art.
Figure 3:
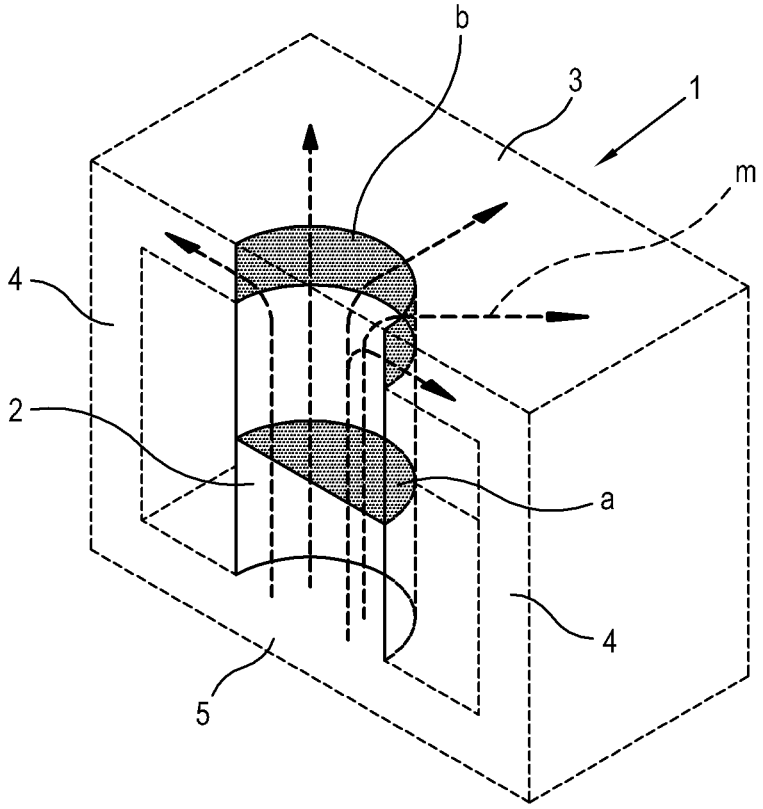
RELATED ART FIG. 3
Figure 4:
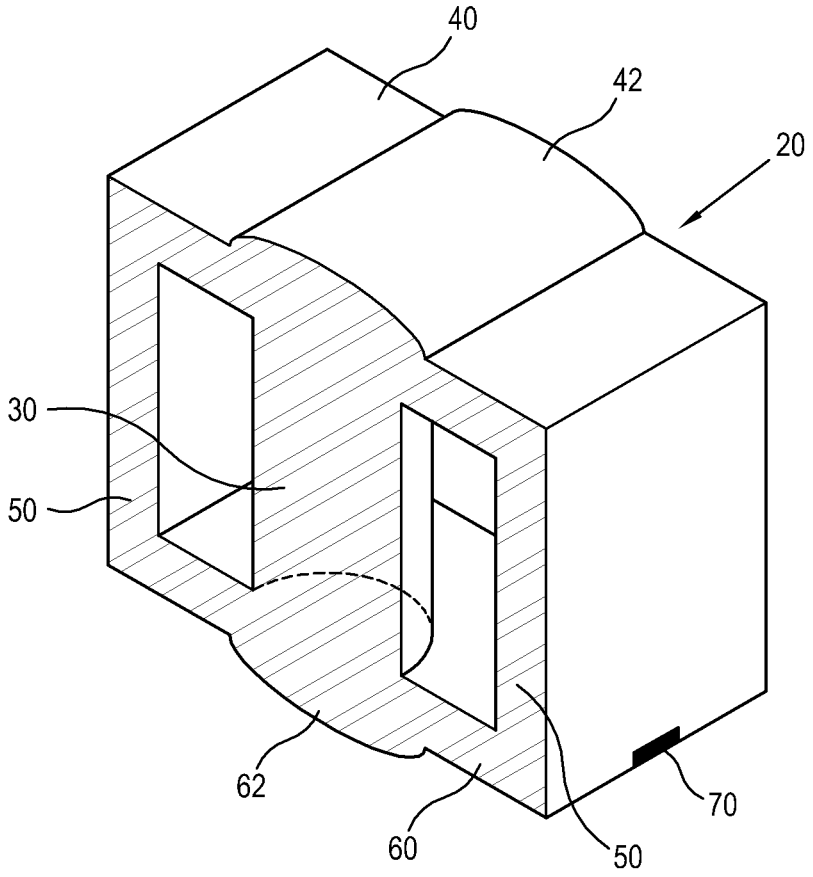
FIG. 4 is a cross-sectional view which schematically illustrates a core of an inductor according to an exemplary embodiment.
Figure 5:
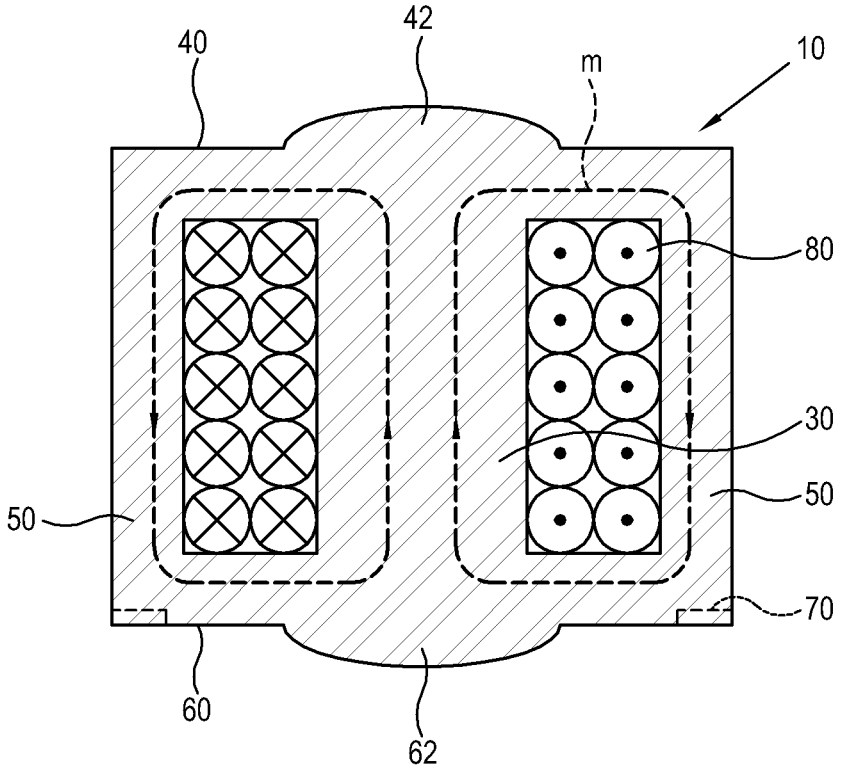
FIGS. 5 and 6 are cross-sectional views of the core which schematically illustrate a path of magnetic flux circulated in the inductor according to an exemplary embodiment.
Figure 6:
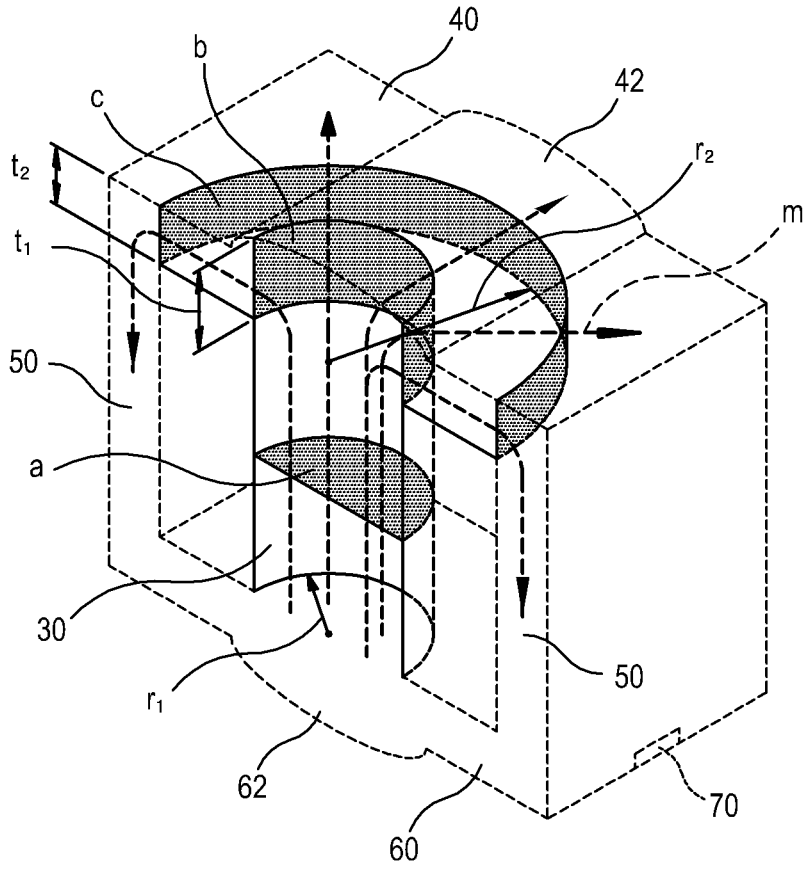

FIGS. 4 to 6 illustrate an inductor core and an inductor mounted on a printed circuit board (PCB) of an electronic device according to an exemplary embodiment.

As shown in FIGS. 4 and 5, the inductor 10 according the exemplary embodiments includes a coil 80 in which an electric current flows and the core 20 which the coil 80 is wound around.

The coil 80 is provided to obtain inductance of the inductor 10 and is formed of a wire having good conductivity. The coil 80 is formed by coating the wire with an insulating material and the coil 80 wound in a cylindrical or spiral shape for use.

The core 20 includes a central portion 30 which the coil 80 is wound around, extension portions 40 and 60 extending from opposite edges of the central portion 30, and lateral portions 50 formed outside the central portions 30.

The central portion 30 is provided in a cylindrical shape in a center of the inductor 10, and the coil 80 is wound around the central portion 30. When an electric current flows in the coil 80 wound around the central portion 30, magnetic flux is generated.

Referring to FIG. 5, when the electric current enters a right side of the coil and exits from a left side of the coil based on FIG. 5, that is, when the electric current flows counterclockwise on the coil 80 wound around the central portion 30, viewed from a top of the core 20, the magnetic flux m is formed in the central portion 30 and travels in a vertically upward direction in the central portion 30 as indicated by arrows.

The central portion 30 is designed to have a diameter and length which correspond to a desired inductance of the inductor 10. However, the central portion 30 is not limited to the aforementioned form but may have various shapes, for example, a rectangular pillar.

The lateral portions 50 extend from the extension portions 40 and 60 and face the central portion 30 with the coil 80 disposed there between. The lateral portions 50 are provided to form a closed circulation path of the magnetic flux m which is formed in the central portion 30 to circulate back to the central portion 30.

The portions 40 and 60 are formed in the shape of a rectangular plate which extends from the opposite edges of the central portion 30 and having a predetermined thickness $t_2$. The extension portions 40 and 60, however, are not limited to the foregoing shape but may be formed in various shapes; for example, a circular shape.

The extension portions 40 and 60 include a first extension portion 40 formed above the central portion 30 and a second extension portion 60 formed under the central portion 30. The extension portions 40 and 60 respectively include protrusions 42 and 62 which protrude with a larger diameter than the diameter of the central portion 30. The first extension portion 40 and the second extension portion 60 have the same shape, and thus the following description will be made with reference to the first extension portion 40.

The magnetic flux m formed in the central portion 30 flows in the first extension portion 40. Here, the magnetic flux m travelling vertically curves in a horizontal direction in an overlapping area of the central portion 30 and the first extension portion 40 and travels in the horizontal direction along the first extension portion 40 radially with respect to the central portion 30.

As shown in FIG. 6, a height $t_1$ at a first position of the first extension portion 40 in contact with an edge of the central portion 30 is larger than a height $t_2$ at a second position spaced away from the edge of the central portion 30 by a predetermined distance which is longer than the first position. That is, the protrusion 42 is formed with a height which becomes shorter from a center of the central portion 30 to the lateral portions 50.

Thus, a height $t_1$ of a first cross section b formed by vertically cutting from the edge of the central portion 30, that is, a boundary between the central portion 30 and the first extension portion 40, to an outside of the protrusion 42 is larger than a height $t_2$ of a second cross section c having a predetermined radius $r_2$ in an area of the first extension portion 40 where the protrusion 42 is not formed.

The magnetic flux m traveling vertically in the central portion 30 curves in the horizontal direction in the first cross section b. Magnetic flux through a surface is proportionate to a number of magnetic field lines passing through that surface. Thus, when the first cross section b has a smaller area than a cross-sectional area of the central portion 30, the magnetic flux m formed in the central portion 30 becomes concentrated in the first cross section b having the smaller area, causing a bottleneck phenomenon. To reduce the bottleneck phenomenon, the area of the first cross section b is at a predetermined level or higher. The area of the first cross section b may be at least equivalent to or larger than the cross-sectional area a of the central portion 30.

In particular, the bottleneck phenomenon in the core 20 is determined, based on a cross-sectional area of the core in which the magnetic flux m flows. FIG. 6 is a cross-sectional view formed by cutting across a center of the core 20. In FIG. 6, a cross section a of the central portion 30 and the first cross section b and the second cross section c of the first extension portion 40 are half of their actual sizes. Although FIG. 6 shows half of the cross sections, the following description will be made with reference to actual cross-sectional areas.

As the central portion 30 has a circular cross section, the magnetic flux formed on the circular cross section travels radially from the central portion 30 in the first extension portion 40. Thus, as shown in FIG. 6, the magnetic flux m formed on the cross section of the central portion 30 passes through an area in a circular band shape, such as the first cross section b and the second cross section c of the first extension portion 40.

The central portion 30 has a radius of $r_1$, the area of the cross section a is $\pi r_1^2$ and the area of the first cross section b where the magnetic flux curves to the first extension portion 40 is $2\pi r_1 t_1$. To reduce the bottleneck phenomenon of magnetic flux, the area of the first cross section b is at least equivalent to or larger than the area of the cross section a of the central portion 30. That is, to satisfy $2\pi r_1 t_1 \geq \pi r_1^2$, the height $t_1$ of the first cross section b is equivalent to or larger than half of the radius $r_1$ of the central portion 30.

As the second cross section c is the radius $r_2$ from the center of the central part 30 and has the height $t_2$, the area of the second cross section c is $2\pi r_2 t_2$. Thus, since the area thereof is also proportionally large, the bottleneck phenomenon of magnetic field does not occur without increasing the height thereof as in the first cross section b.

Similarly to the first extension portion 40, the second extension portion 60 may be involved in the bottleneck phenomenon of magnetic flux on a boundary with the central portion 30, since the magnetic flux m passing through the lateral portions 50 curves back to the central portion 30. Thus, the protrusion 62 may be provided on the second extension portion 60 in the same manner as on the first extension portion 40.

The second extension portion 60 includes a connection terminal 70 mounted on the PCB and electrically connectable thereto.

The core 20 is not limited to the foregoing shape but may be formed for resolving the bottleneck phenomenon of magnetic flux such that a vertical side through which magnetic flux passes along the circulation path of the magnetic flux has a uniform area across the core 20.

A pair of cores 20 may be provided in a form such that upper and lower portions formed by horizontally cutting across the center of the core 20 have the same form.

Figure 7:
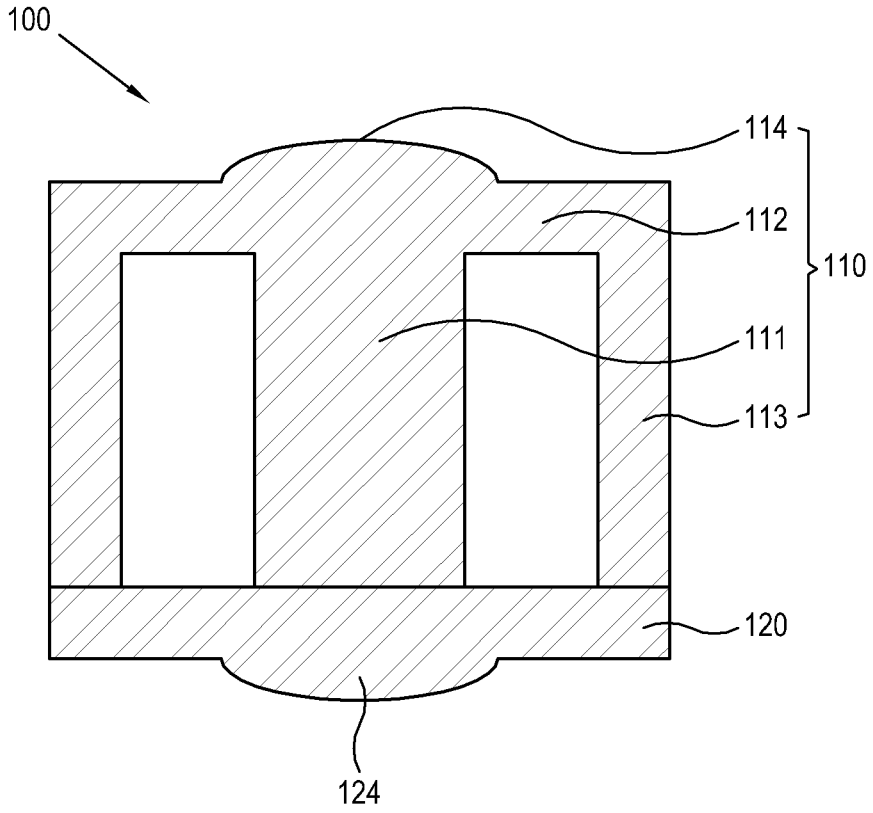
FIGS. 7 and 8 are cross-sectional views which schematically illustrate inductor cores according to other exemplary embodiments.

FIG. 7 is a cross-sectional view which schematically illustrates an inductor core according to another exemplary embodiment.

As shown in FIG. 7, the core 100 may include a body 110 having an E-shaped cross section and a base 120 combined with a lower portion of the body 110.

The body 110 includes a central portion 111 in a cylindrical shape that a coil is wound around, an upper portion 112 which extends from an upper portion of the central portion 111 and a lateral portion 113 which extends from an end of the upper portion 112 and disposed outside the central portion 111 to encompass the central portion 111.

The upper portion 112 includes a protrusion 114 that protrudes outwards with a larger diameter than a diameter of the central portion 111 to prevent a bottleneck phenomenon of the magnetic field.

The base 120 is formed in the same shape as the upper portion 112 and combined with a lower portion of the body 110. The base 120 includes a protrusion 124 which protrudes outwards in the same manner as the upper portion 112. This structure enables magnetic flux generated in the central portion 111 to form a closed circulation path, traveling through the upper portion 112, the lateral portion 113 and the base 120 and then back to the central portion 111.

Figure 8:
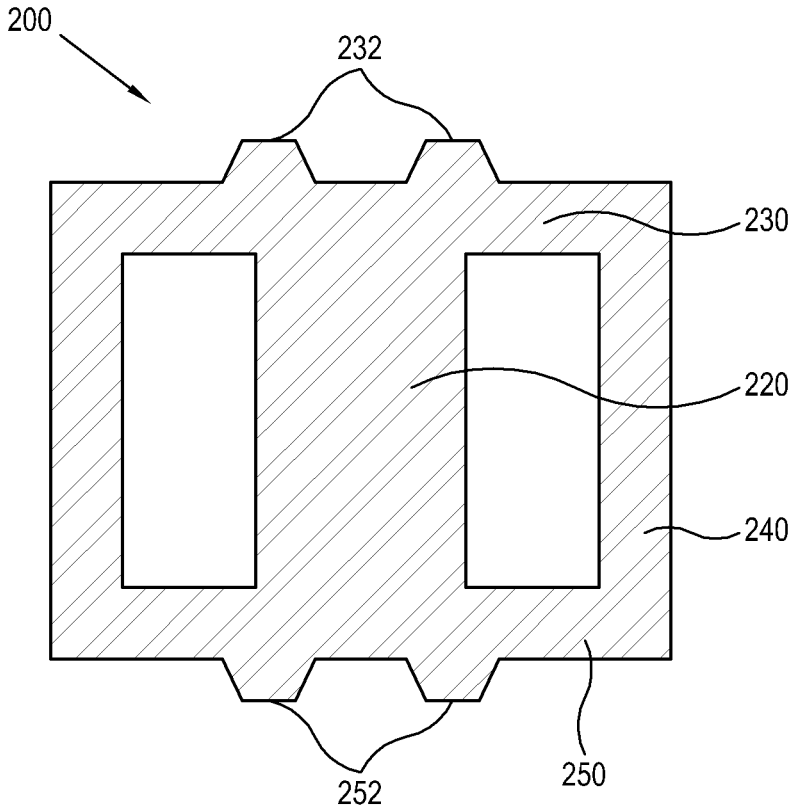

FIG. 8 is a cross-sectional view which schematically illustrates an inductor core with a different shape of a protrusion, according to an exemplary embodiment.

As shown in FIG. 8, the core 200 includes a central portion 220 that is provided in a cylindrical shape in a center of the inductor and that a coil is wound there around, extension portions 230 and 250 which extend from opposite edges of the central portion 220 and have a predetermined thickness, and lateral portions 240 which extend from the extension portions 230 and 250 and disposed outside the central portion 220.

The extension portions 230 and 250 may respectively include protrusions 232 and 252 which protrude outwards to enable magnetic flux generated in the central portion 220 to smoothly travel without generation of the bottleneck phenomenon.

The protrusions 232 and 252 are provided to increase an area of only a region where a bottleneck phenomenon of magnetic flux occurs and are formed in a ring shape having the same diameter as that of the central portion 220 and predetermined internal and external thicknesses. With this structure, a bottleneck phenomenon of magnetic flux may be resolved while minimizing materials of the core 200.

A pair of cores 200 may be provided in a form such that upper and lower portions formed by horizontally cutting across the center of the core 200 have the same shape. Also, the core 200 may have a base in the same manner as the core 100 of FIG. 7.

Figure 9:
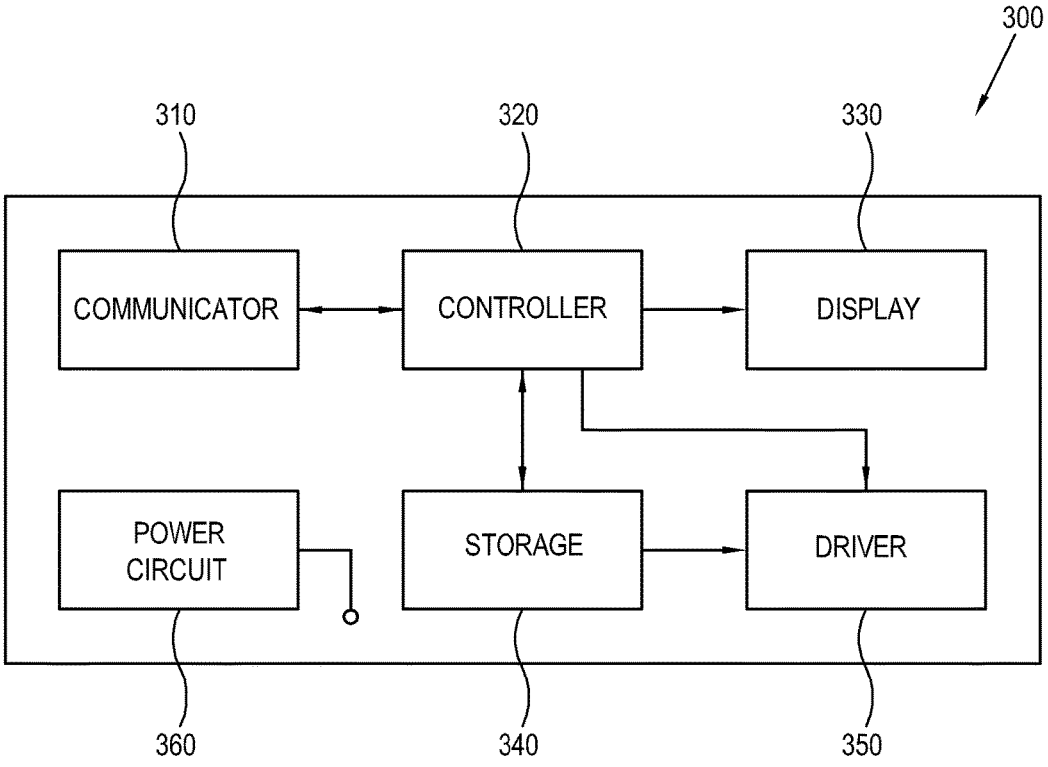
FIG. 9 is a block diagram which schematically illustrates a configuration of an electronic device according to an exemplary embodiment.

FIG. 9 is a block diagram which schematically illustrating a configuration of an electronic device 300 according to an exemplary embodiment.

As shown in FIG. 9, the electronic device 300 includes a communicator 310 configured to receive a data signal from the outside, a driver 350 configured to perform a preset operation which corresponds to the signal received through the communicator 310, a storage 340 configured to store information needed for the operation of the driver 350 and a program, a display 330 configured to display an image, and a power circuit 360 configured to be supplied with external power to supply power needed for driving the foregoing components.

The inductor according to the exemplary embodiment may be mounted on a PCB of the power circuit 360 or the driver 350. Here, the inductor may be formed with a minimized height, securing output capacity, thereby being applied to the electronic device 300 which is manufactured to be slim.

Figure 10:
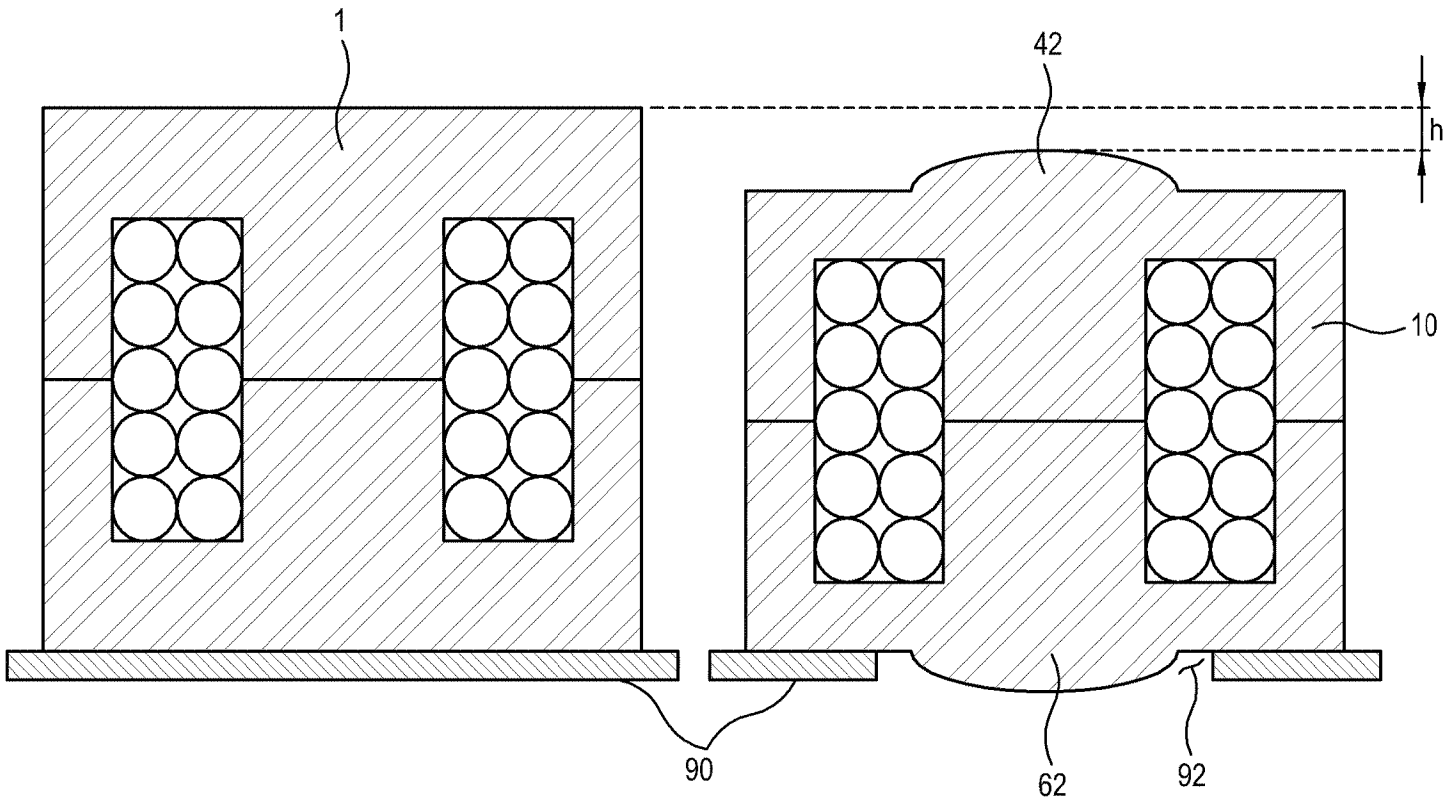
FIG. 10 is a cross-sectional view comparing an inductor of the related art and the inductor according to an exemplary embodiment, mounted on a printed circuit board.

FIG. 10 is a cross-sectional view which comprises a inductor 1 of the related art and the inductor 10 according to an exemplary embodiment which has the same capacity and is mounted on PCBs 90.

As shown in FIG. 10, the inductor 1 of the related art is formed with upper and lower portions having a sufficiently thick height to prevent a bottleneck phenomenon of magnetic flux.

The inductor 10 according to the exemplary embodiment includes protrusions 42 and 62 formed at upper and lower portions of the core only in an area where a bottleneck phenomenon occurs so as to prevent a bottleneck phenomenon of magnetic flux.

In addition, a hole 92 into which the lower protrusion 62 is inserted is provided on the PCB 90. When the inductor 10 is mounted on the PCB 90, the lower protrusion 62 is inserted into the hole 92 and an area where the protrusion 62 is not formed rests on PCB 90.

With this structure, a mounted height of the inductor 10 may be reduced by h as compared with a mounted height of the inductor 1 in the related art.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. An electronic device comprising:

a printed circuit board on which an electronic component configured to drive the electronic device is mounted, the printed circuit board including a hole; and an inductor mounted on the printed circuit board, wherein the inductor comprises a coil in which an electric current is configured to flow and a core that the coil is wound around, wherein the core comprises a central portion that the coil is wound around; extension portions extending from opposite edges of the central portion according to a circulation path of magnetic flux generated by the electric current of the coil; and lateral portions extending from the extension portions along the circulation path of the magnetic flux and facing the central portion with the coil disposed therebetween, wherein a first height at a first position of the extension portions corresponding to the edges of the central portion is larger than a second height at a second position of the extension portions spaced outwardly from the first position by a predetermined distance towards the lateral portions, and the first height at the first position of the extension portions is larger than a third height at a position of the central portion spaced inwardly from the first position of the extension portions, the second height being the same as the third height, and wherein the core includes a first protrusion of a ring shape at an upper side of the core and corresponding to the edges of the central portion and protruding from the upper side in an upper direction, and a second protrusion of a ring shape at a lower side of the core and corresponding to the edges of the central portion and protruding from the lower side in a lower direction opposite to the upper direction, and each of a diameter of the first protrusion and a diameter of the second protrusion is the same as a diameter of the central portion.

2. The electronic device of claim 1, wherein a first cross section at the first position has a predetermined area so that a bottleneck phenomenon of the magnetic flux is not generated at the first position.

3. The electronic device of claim 2, wherein the area of the first cross section is at least equivalent to or larger than a cross-sectional area of the central portion.

4. The electronic device of claim 1, wherein a thickness of the extension portions at the first position is larger than a thickness of the extension portions at the second position.

5. The electronic device of claim 1, wherein the core is configured to be provided such that a vertical side which the magnetic flux passes through along the circulation path of the magnetic flux has a uniform area.

6. The electronic device of claim 1, wherein the extension portions comprise a first extension portion formed above the central portion and a second extension portion formed under the central portion, and the second extension portion comprises a connection terminal mounted on the printed circuit board and electrically connected thereto.

7. The electronic device of claim 6, wherein at least one of the first extension portion and the second extension portion comprises a protrusion which extends from one side thereof such that a thickness at the first position is larger than a thickness at the second position.

8. An electronic device comprising:

a printed circuit board on which an electronic component configured to drive the electronic device is mounted, the printed circuit board including a hole; and an inductor mounted on the printed circuit board, wherein the inductor comprises a coil in which an electric current is configured to flow and a core that the coil is wound around, wherein the core comprises a central portion that the coil is wound around; extension portions extending from opposite edges of the central portion according to a circulation path of magnetic flux generated by the electric current of the coil; and lateral portions which extend from the extension portions along the circulation path of the magnetic flux and facing the central portion with the coil disposed therebetween, wherein the core is configured to be provided such that a vertical side which the magnetic flux passes through along the circulation path of the magnetic flux has a uniform area, wherein a first height at a first position of the extension portions corresponding to the edges of the central portion is larger than a second height at a second position of the extension portions spaced outwardly from the first position by a predetermined distance towards the lateral portions, and the first height at the first position of the extension portions is larger than a third height at a position of the central portion spaced inwardly from the first position of the extension portions, the second height being the same as the third height, and wherein the core includes a first protrusion of a ring shape at an upper side of the core and corresponding to the edges of the central portion and protruding from the upper side in an upper direction, and a second protrusion of a ring shape at a lower side of the core and corresponding to the edges of the central portion and protruding from the lower side in a lower direction opposite to the upper direction, and each of a diameter of the first protrusion and a diameter of the second protrusion is the same as a diameter of the central portion.

9. The electronic device of claim 8, wherein the extension portions comprise a first extension portion formed above the central portion and a second extension portion formed under the central portion, and the second extension portion comprises a connection terminal mounted on the printed circuit board and electrically connected thereto.

10. The electronic device of claim 9, wherein the first extension portion and the second extension portion comprise a protrusion extending from one side thereof.

* * * * *